US009011090B2

(12) United States Patent
Huang et al.

(10) Patent No.: US 9,011,090 B2
(45) Date of Patent: Apr. 21, 2015

(54) CENTRIFUGAL FAN

(75) Inventors: Yu-Nien Huang, Taoyuan County (TW); Chun-Fa Tseng, Kaohsiung (TW); Chun-Che Chiu, New Taipei (TW); Yi-Mei Chiu, Taoyuan County (TW)

(73) Assignee: Quanta Computer Inc., Taoyuan Shien (TW)

( * ) Notice: Subject to any disclaimer, the term of this patent is extended or adjusted under 35 U.S.C. 154(b) by 479 days.

(21) Appl. No.: 13/533,679

(22) Filed: Jun. 26, 2012

(65) Prior Publication Data

US 2013/0195638 A1 Aug. 1, 2013

(30) Foreign Application Priority Data

Jan. 31, 2012 (TW) ..... 101103073 A

(51) Int. Cl.
*F04D 17/16* (2006.01)
*F04D 25/06* (2006.01)
*F04D 29/42* (2006.01)

(52) U.S. Cl.
CPC ..... *F04D 25/0613* (2013.01); *F04D 29/4226* (2013.01)

(58) Field of Classification Search
CPC ..... F04D 25/0613; F04D 25/0646; F04D 29/4226
USPC ..... 415/203–206, 232
See application file for complete search history.

(56) References Cited

U.S. PATENT DOCUMENTS

| | | | | |
|---|---|---|---|---|
| 2007/0177349 | A1 * | 8/2007 | Pokharna et al. | 361/696 |
| 2009/0010757 | A1 * | 1/2009 | Hwang et al. | 415/204 |
| 2009/0129921 | A1 * | 5/2009 | Hwang et al. | 415/206 |
| 2009/0142179 | A1 | 6/2009 | Hwang et al. | |

FOREIGN PATENT DOCUMENTS

| | | |
|---|---|---|
| JP | 2003-769380 | 9/2003 |
| TW | I300692 | 9/2008 |
| TW | I324225 | 5/2010 |
| TW | I346744 | 8/2011 |

* cited by examiner

*Primary Examiner* — Nathaniel Wiehe
*Assistant Examiner* — Woody A Lee, Jr.
(74) *Attorney, Agent, or Firm* — Rabin & Berdo, P.C.

(57) ABSTRACT

A centrifugal fan includes a centrifugal impeller, a first housing, a second housing, an annular guide ring and a driving device. The centrifugal impeller has a hub and blades connected to and disposed around the hub. The first housing and the second housing cooperatively define a hollow chamber and an air outlet. An air inlet is formed in a central section of the second housing. A first arc structure is located on an inner surface around the air inlet of the second housing. Support brackets respectively extend from an end close to a tongue of the second housing and an end away from the tongue of the second housing. The support brackets are perpendicular to the second housing. The annular guide ring has a second arc structure close to an outermost margin of inner surfaces of the blades. The driving device is used for rotating the centrifugal impeller.

14 Claims, 8 Drawing Sheets

CENTRIFUGAL FAN

RELATED APPLICATIONS

This application claims priority to Taiwan Application Serial Number 101103073, filed Jan. 31, 2012, which is herein incorporated by reference.

BACKGROUND

1. Field of Invention

The present invention relates to a fan. More particularly, the present invention relates to a centrifugal fan.

2. Description of Related Art

Electric apparatuses, such as notebook computers, generate heat when operating. If the heat is not dissipated efficiently, the electric apparatuses may malfunction. In serious situations, the heat may damage electric elements in the electric apparatuses. Furthermore, burning electric elements may hurt users. One method for reducing the heat in electric apparatuses involves the use of centrifugal fans therein. Each centrifugal fan may include blades and a driving device. Heat generated by operation of the electric elements may be dissipated by airflow generated by the centrifugal fans.

Using a centrifugal fan increases the quantity of air utilized for cooling. Nevertheless, airflow efficiency and space utilization of the centrifugal fan the needs to be improved.

Therefore, there is a need to develop a centrifugal fan that is capable of avoiding the foregoing disadvantages.

SUMMARY

The present invention provides a centrifugal fan.

In accordance with the present invention, the centrifugal fan includes a centrifugal impeller, a first housing, a second housing, an annular guide ring, and a driving device. The centrifugal impeller has a hub and several blades, in which the blades are connected to and disposed around the hub in an angularly spaced-apart manner. The first housing and the second housing cooperatively define a hollow chamber and an air outlet. An air inlet is formed in a central section of the second housing and a first arc structure is located on an inner surface around the air inlet of the second housing, in which a thickness of the first arc structure is decreased progressively from the air inlet along a radial outward direction. Several support brackets respectively extend from an end close to a tongue of the second housing and an end away from the tongue of the second housing for connecting with a support plate. The support brackets are perpendicular to the second housing. The annular guide ring is located in an outer margin of the blades and has a second arc structure located in an inner surface close to an outermost margin of the blades. A thickness of the second arc structure is decreased progressively from the outermost margin of the blades along a radial inward direction, in which the second arc structure is arranged opposite to the first arc structure and a gap is formed between the second arc structure and the first arc structure. A driving device is located in the support plate and connected to the hub for rotating the centrifugal impeller.

According to another embodiment disclosed herein, an outer surface of the second housing is essentially coplanar with an outer surface of the annular guide ring.

According to another embodiment disclosed herein, a perpendicular length from the support plate to the first housing is greater than a perpendicular length from the centrifugal impeller to the first housing.

According to another embodiment disclosed herein, the support plate is non-coplanar with the outer surface of the second housing and a gap is formed between the support plate and the blades.

According to another embodiment disclosed herein, the gap between the second arc structure and the first arc structure ranges from about 0.3 mm to about 0.5 mm.

According to another embodiment disclosed herein, the annular guide ring further includes a planar structure, and a thickness of the planar structure ranges from about 0.3 mm to about 0.5 mm.

According to another embodiment disclosed herein, a maximum thickness of the first arc structure is about 1.5 times to 2.5 times the thickness of the planar structure.

According to another embodiment disclosed herein, the second housing further includes a planar structure and a thickness of the planar structure is about 0.3 to about 0.4 times the maximum thickness of the first arc structure.

In accordance with the present invention, a centrifugal fan includes a centrifugal impeller, a first housing, a second housing, an annular guide ring, and a driving device.

The centrifugal impeller has a hub and several blades, in which the blades are connected to and disposed around the hub in an angularly spaced-apart manner. The first housing and the second housing cooperatively define a hollow chamber and an air outlet. An air inlet is formed in a central section of the first housing and a first arc structure is located in an inner surface around the air inlet of the first housing, in which a thickness of the first arc structure is decreased progressively from the air inlet along a radial outward direction. The annular guide ring is located in an outer margin of the blades and has a second arc structure close to an outermost margin of an inner surface of the blades. A thickness of the second arc structure is decreased progressively from the outermost margin of the blades along a radial inward direction, in which the second arc structure is arranged opposite to the first arc structure and a gap is formed between the second arc structure and the first arc structure. The driving device is located in the second housing and connected to the hub for rotating the centrifugal impeller.

According to another embodiment disclosed herein, an outer surface of the first housing is essentially coplanar with an outer surface of the annular guide ring.

According to another embodiment disclosed herein, the gap between the second arc structure and the first arc structure ranges from about 0.3 mm to about 0.5 mm.

According to another embodiment disclosed herein, the annular guide ring further comprises a planar structure and a thickness of the planar structure ranges from about 0.3 mm to about 0.5 mm.

According to another embodiment disclosed herein, a maximum thickness of the first arc structure is about 1.5 times to about 2.5 times the thickness of the planar structure.

According to another embodiment disclosed herein, the second housing further comprises a planar structure and a thickness of the planar structure is about 0.3 to about 0.4 times the maximum thickness of the first arc structure.

Thus, the centrifugal fan herein not only provides several guide structures (e.g., annular guide ring, first arc structure, and second arc structure) to enhance airflow, but also achieves better space utilization in the hollow chamber.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

The present invention provides a centrifugal fan that provides an enhanced configuration for airflow efficiency and to improve the space utilization of the centrifugal fan.

Figure 1:
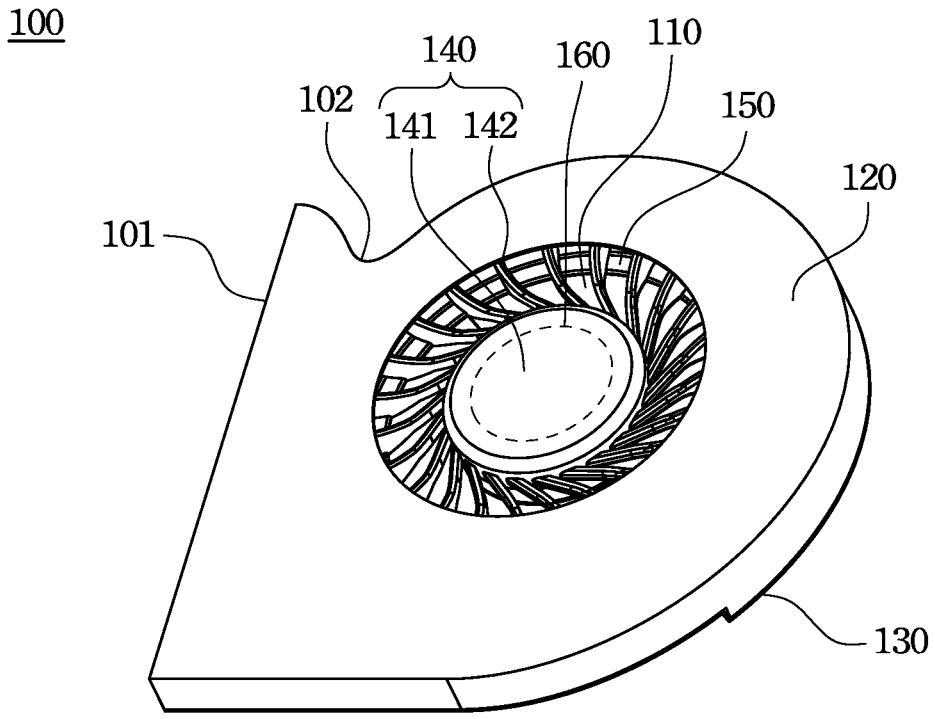
FIG. 1 illustrates a perspective view of a centrifugal fan according to an embodiment of the present invention.
Figure 2:
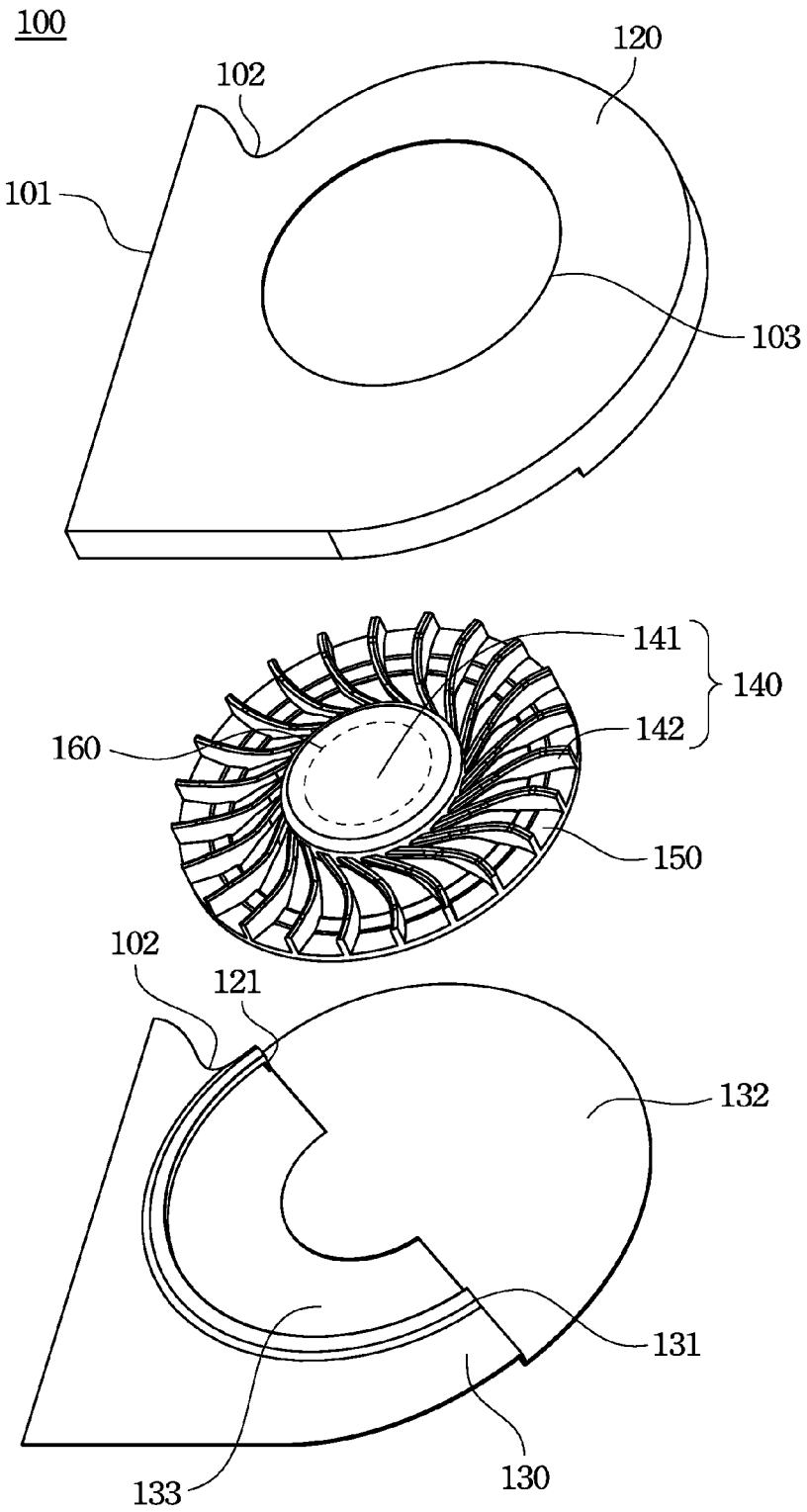
FIG. 2 illustrates an exploded perspective view of the centrifugal fan of FIG. 1.

FIG. 1 shows a perspective view of a centrifugal fan 100 according to an embodiment of the present invention, and FIG. 2 shows an exploded perspective view of the centrifugal fan 100 of FIG. 1. The centrifugal fan 100 includes a first housing 120, a second housing 130, a centrifugal impeller 140, an annular guide ring 150, and a driving device 160. The first housing 120 and the second housing 130 cooperatively define a hollow chamber 110 and an air outlet 101. The centrifugal impeller 140 is disposed in the hollow chamber 110 and has a hub 141 and several blades 142. The blades 142 are connected to the hub 141 and extend outwardly from the same, and are disposed around the hub 141 in an angularly spaced-apart manner. The driving device 160 is connected to the hub 141 for rotating the centrifugal impeller 140 so as to produce airflow which is discharged through the air outlet 101. The annular guide ring 150 is located in an outer margin of the blades 142. That is, the annular guide ring 150 is connected to distal end portions of the blades 142. The second housing 130 is an annular structure and an air inlet 133 is formed in a central section of the second housing 130. The second housing 130 may guide airflow into the hollow chamber 110 through the air inlet 133 utilizing a configuration of the second housing 130. Several support brackets 131 respectively extend from an end close to a tongue 102 of the second housing 130 and an end away from the tongue 102 of the second housing 130 for connecting with a support plate 132. The support brackets 131 are perpendicular to the second housing 130. In addition, a perpendicular length from the support plate 132 to the first housing 120 is greater than a perpendicular length from the centrifugal impeller 140 to the first housing 120. In this embodiment, the first housing 120 has an air inlet 103 and may guide airflow through the air inlet 103 or be connected to other devices.

Figure 3:
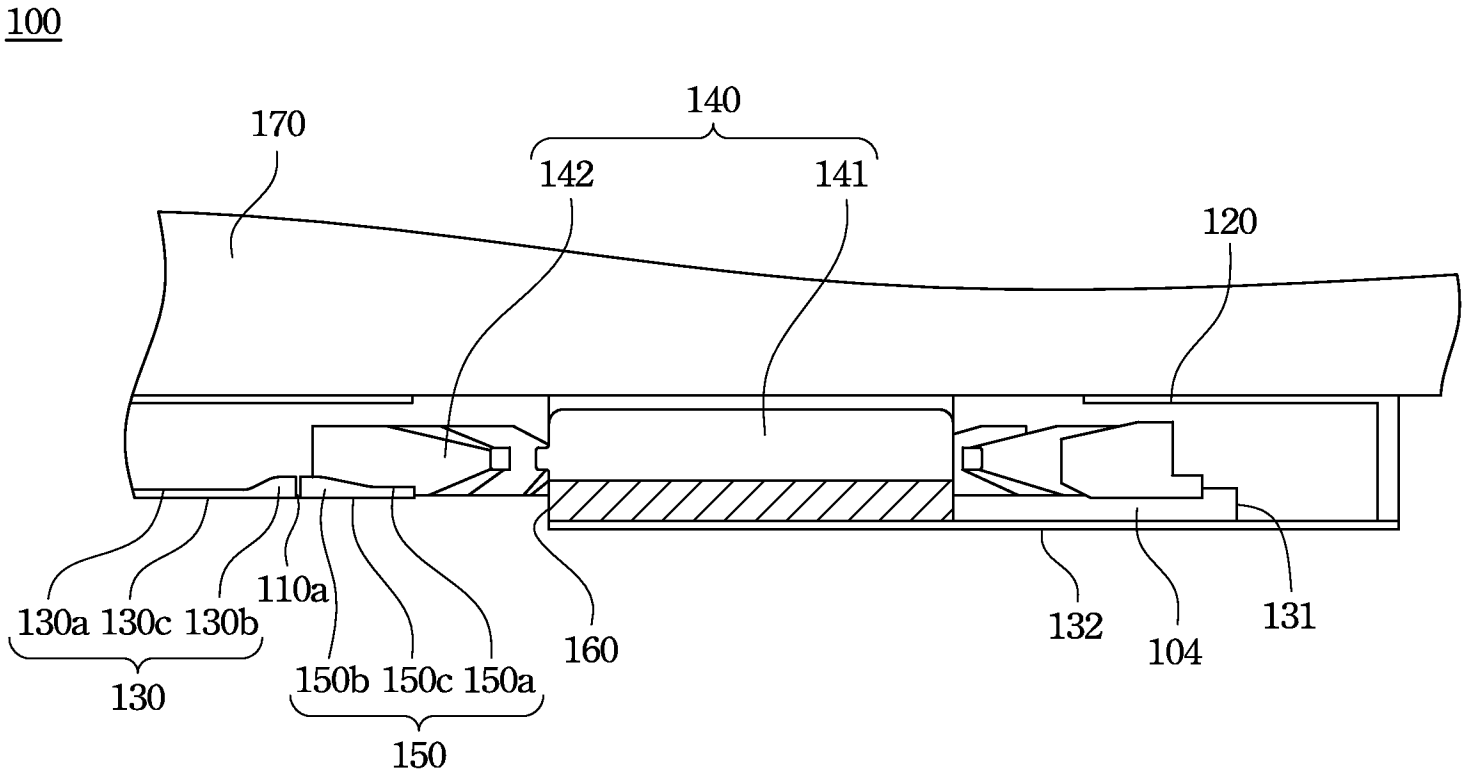
FIG. 3 illustrates a cross-sectional view of the centrifugal fan of FIG. 1.

FIG. 3 shows a cross-sectional view of the centrifugal fan 100 of FIG. 1. The support brackets 131 are connected with the support plate 132 for supporting the driving device 160 so as to increase an available space of the hollow chamber 110 when the first housing 120 is connected to a motherboard 170. A first arc structure 130*b* is located on an inner surface 130*a* around the air inlet 133 (see FIG. 2) of the second housing 130. A thickness of the first arc structure 130*b* is decreased progressively from the air inlet 133 along a radial outward direction. The annular guide ring 150 is located in the outer margin of the blades 142, as described above, and has a second arc structure 150*b* located at an inner surface 150*a* close to an outermost margin of the blades 142. A thickness of the second arc structure 150*b* is decreased progressively from the outermost margin of the blades 142 along a radial inward direction, in which the second arc structure 150*b* is arranged opposite to the first arc structure 130*b* and a gap 110*a* is formed between the second arc structure 150*b* and the first arc structure 130*b*. In this embodiment, an outer surface 130*c* of the second housing 130 is essentially coplanar with an outer surface 150*c* of the annular guide ring 150. In addition, the support plate 132 is non-coplanar with the outer surface 130*c* of the second housing 130 and a gap 104 is formed between the support plate 132 and the blades 142.

Figure 4:
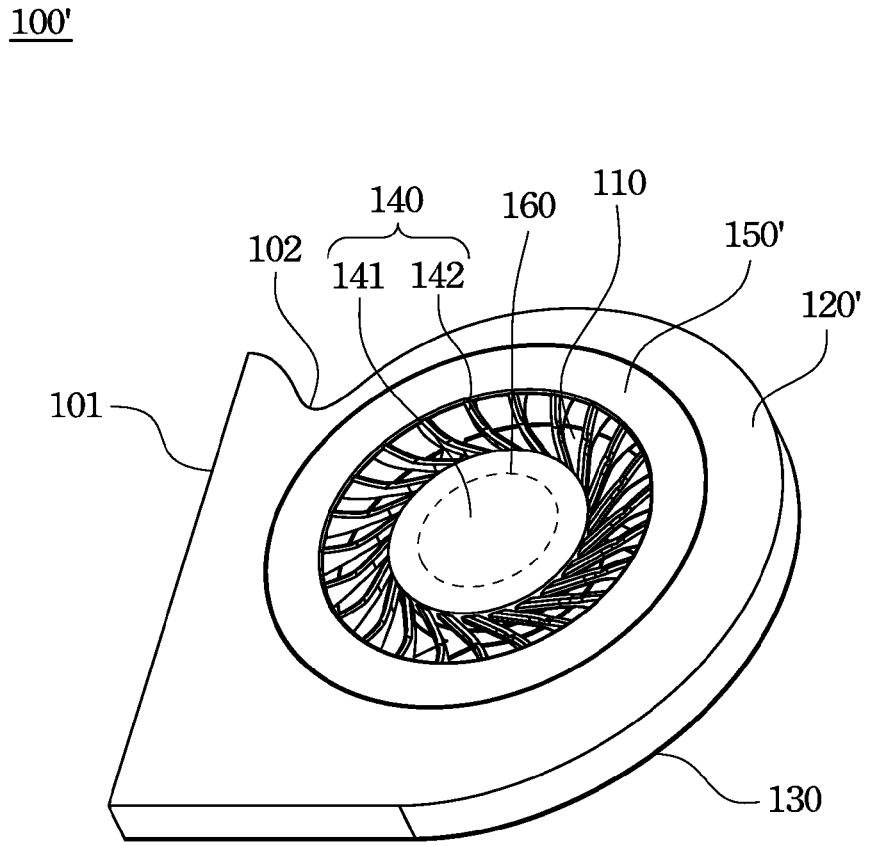
FIG. 4 illustrates a perspective view of a centrifugal fan according to another embodiment of the present invention.
Figure 5:
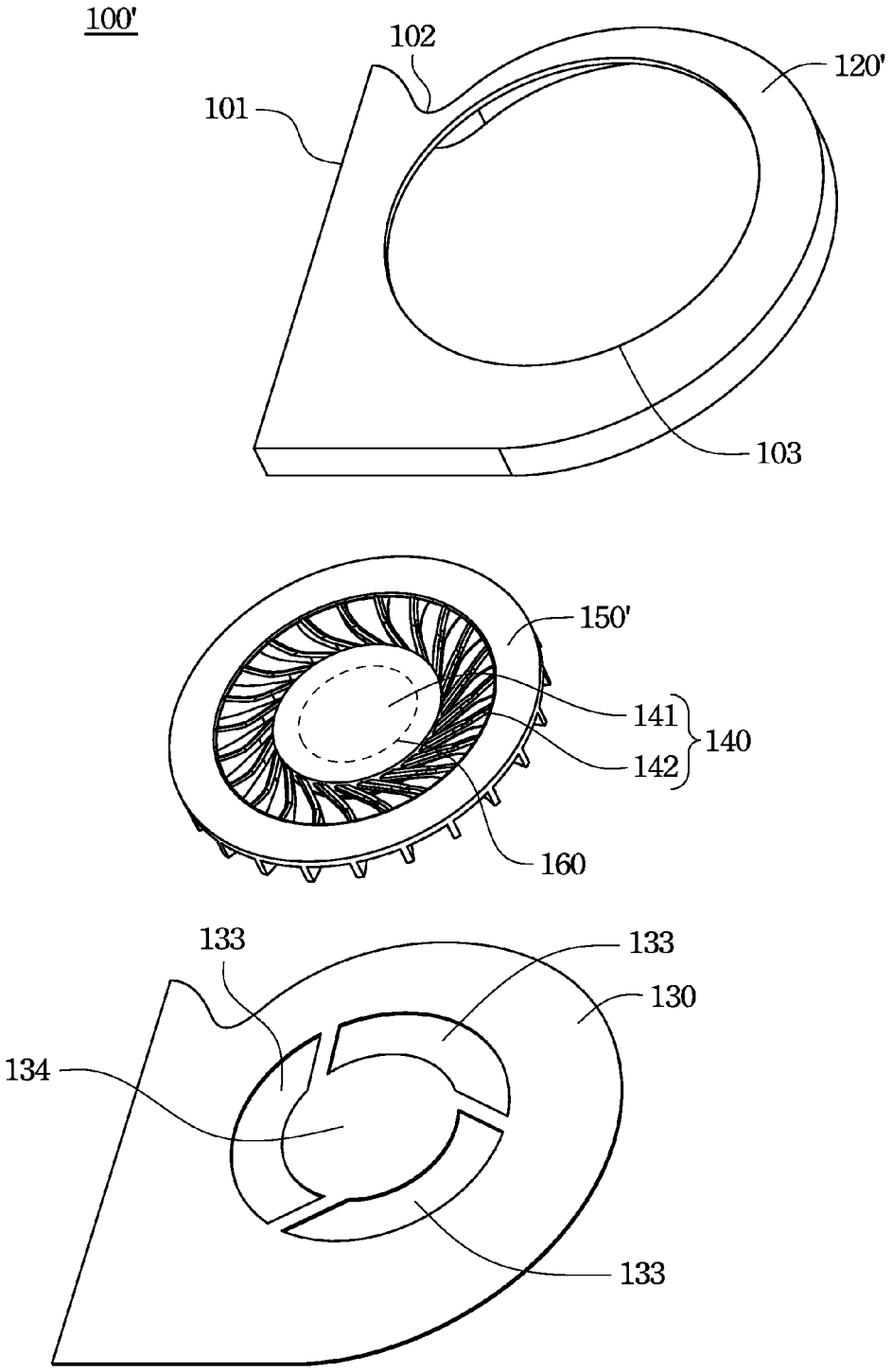
FIG. 5 illustrates an exploded perspective view of the centrifugal fan of FIG. 4.

FIG. 4 shows a perspective view of a centrifugal fan 100' according to another embodiment of the present invention, and FIG. 5 shows an exploded perspective view of the centrifugal fan 100' of FIG. 4. The centrifugal fan 100' includes a first housing 120', a second housing 130, a centrifugal impeller 140, an annular guide ring 150, and a driving device 160. The first housing 120' and the second housing 130 cooperatively define a hollow chamber 110 and an air outlet 101. The centrifugal impeller 140 is disposed in the hollow chamber 110 and has a hub 141 and several blades 142. The blades 142 are connected to the hub 141 and extend outwardly from the same, and are disposed around the hub 141 in an angularly spaced-apart manner. The driving device 160 is connected to the hub 141 for rotating the centrifugal impeller 140 so as to produce airflow which is discharged through the air outlet 101. The annular guide ring 150' is located in an outer margin of the blades 142 close to the first housing 120'. That is, the annular guide ring 150' is connected to distal end portions of the blades 142 on a side of the blades 142 close to the first housing 120'. The first housing 120' is an annular structure and an air inlet 103 is formed in a central section of the first housing 120'. The first housing 120' may guide airflow into the hollow chamber 110 through the air inlet 103 utilizing a configuration of the second housing 130. In this embodiment, the second housing 130 has an annular air inlet 133 and may guide airflow into the hollow chamber 110 through the annular air inlet 133. In addition, a base plate 134 is located in a central section of the second housing 130 and is used for securing the driving device 160.

Figure 6:
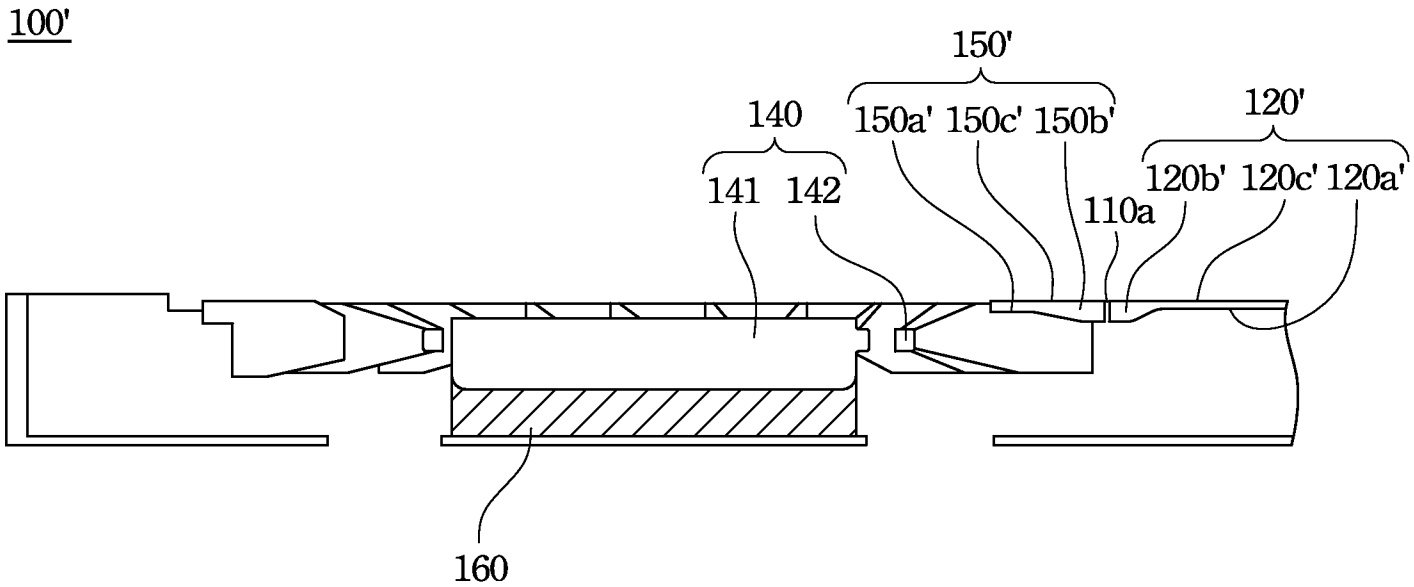
FIG. 6 illustrates a cross-sectional view of the centrifugal fan of FIG. 4.

FIG. 6 shows a cross-sectional view of the centrifugal fan of FIG. 4. A first arc structure 120*b'* is located on an inner surface 120*a'* around the air inlet 103 (see FIG. 5) of the first housing 120'. A thickness of the first arc structure 120*b'* is decreased progressively from the air inlet 103 along a radial outward direction. The annular guide ring 150' is located in the outer margin of the blades 142, as described above, and has a second arc structure 150*b'* located at an inner surface 150*a'* close to an outermost margin of the blades 142. A thickness of the second arc structure 150*b'* is decreased progressively from the outermost margin of the blades 142 along a radial inward direction, in which the second arc structure 150*b'* is arranged opposite to the first arc structure 120*b'* and a gap 110*a* is formed between the second arc structure 150*b'* and the first arc structure 120*b'*. In this embodiment, an outer surface 120*c*' of the second housing 120' is essentially coplanar with an outer surface 150*c*' of the annular guide ring 150'.

Figure 7:
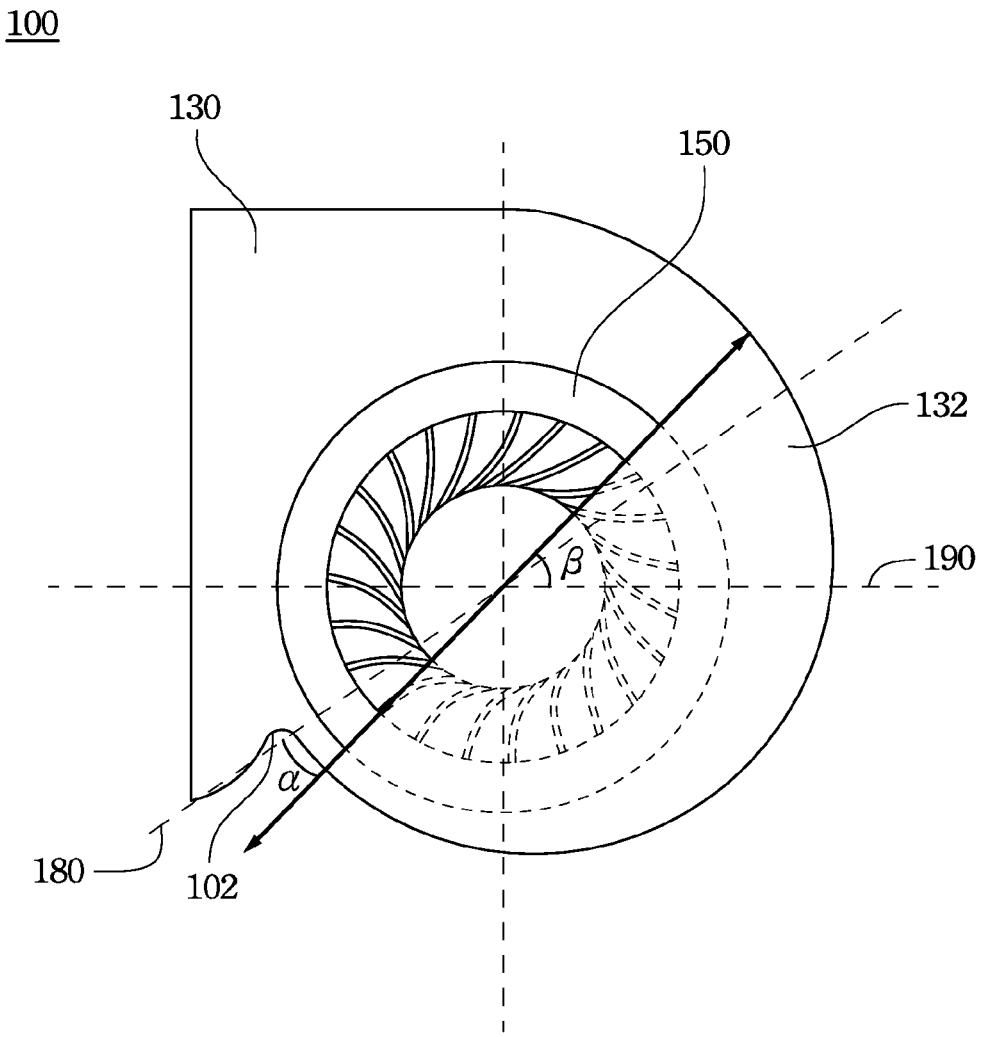
FIG. 7 illustrates a schematic view of a support plate of the centrifugal fan.

FIG. 7 shows a schematic view of the support plate 132 of the centrifugal fan 100. An angle α is formed by the support plate 132 close to the tongue 102 and a second axle 190. An angle β is formed by the support plate 132 away from the tongue 102 and a first axle 180. In this embodiment, Computational Fluid Dynamics (CFD) modeling is used to obtain data of the angle α and he angle β. The angle α ranges from about 0° to about 45° and the angle β ranges from about 0° to about 90°. Using the above data, the second housing 130 can be configured to have sufficient room to guide airflow into the centrifugal fan 100.

Figure 8:
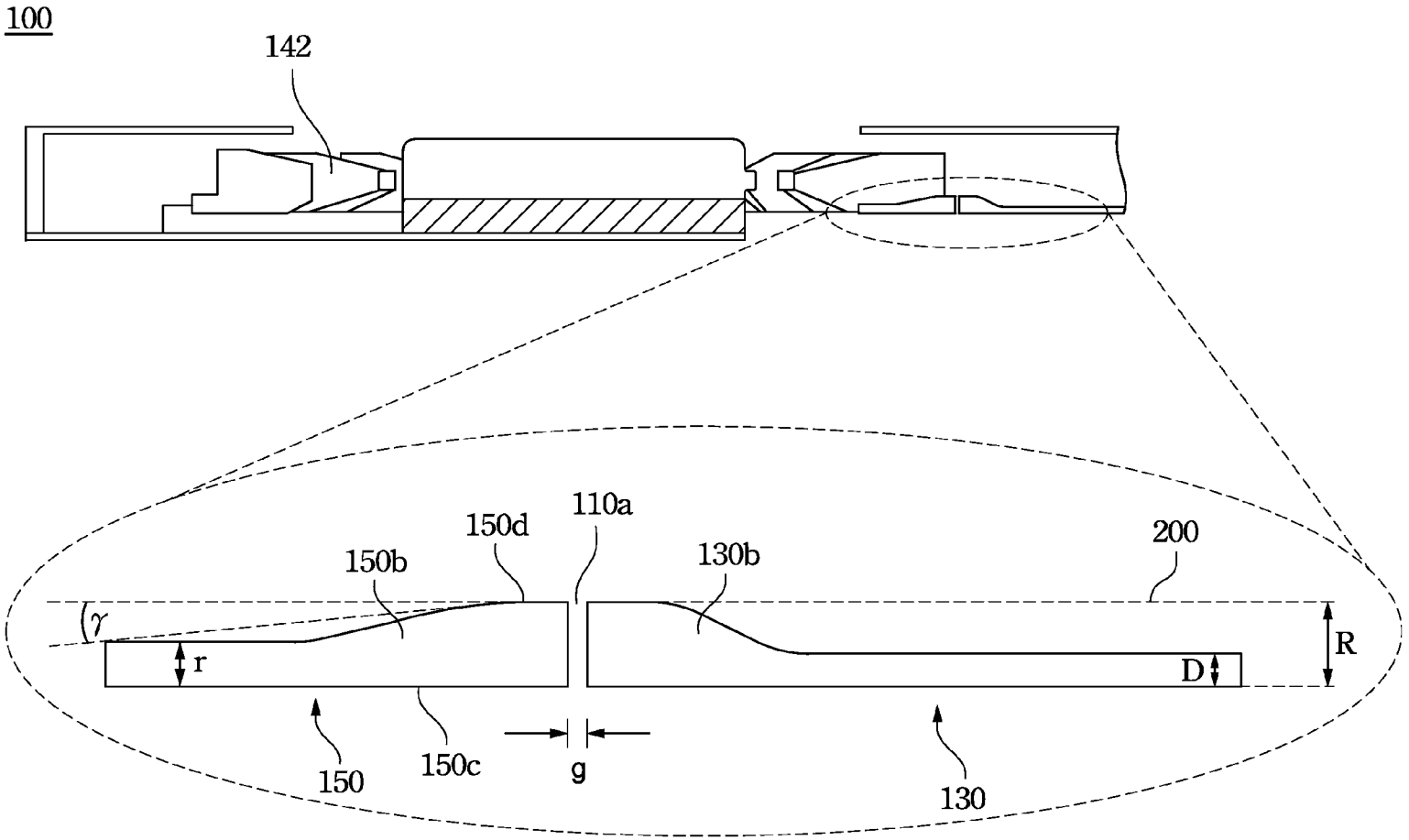
FIG. 8 illustrates a schematic view of a first arc structure and a second arc structure of the centrifugal fan.

FIG. 8 shows a schematic view of the first arc structure 130*b* and the second arc structure 150*b* of the centrifugal fan 100. In this embodiment, Computational Fluid Dynamics (CFD) modeling is used to obtain the data described below.

The gap 110*a* between the second arc structure 150*b* and the first arc structure 130*b* ranges from about 0.3 mm to about 0.5 mm. An angle γ formed by a horizontal line 200, which is drawn extending from an arc surface 150*d* of the second arc structure 150*b* and parallel to a plane formed by the outer surface 150*c*, and a line, which is drawn from the arc surface 150*d* of the second arc structure 150*b* to a point of the annular guide ring 150 that is furthest from the gap 110*a* and at an upper surface of a planar structure of the annular guide ring 150 opposite the outer surface 150*c* the annular guide ring 150, ranges from about 3° to about 8°. A maximum thickness R of the first arc structure 130*b* is about 1.5 times to about 2.5 times a thickness r of the planar structure of the annular guide ring 150. A thickness D of a planar structure of the second arc structure 130*b* is about 0.3 times to about 0.4 times the maximum thickness R of the first arc structure 130*b*.

According to above-described embodiments, the centrifugal fan of the present invention not only provides several kinds of guide structures (e.g., annular guide ring, first arc structure, and second arc structure) to enhance airflow, but also enhances space utilization of the hollow chamber such that larger blades may be used in the centrifugal fan or a smaller-sized centrifugal fan may be manufactured.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A centrifugal fan, comprising:

a centrifugal impeller having a hub and a plurality of blades, the blades being connected to and disposed around the hub in an angularly spaced-apart manner;

a first housing and a second housing cooperatively defining a hollow chamber and an air outlet, an air inlet being formed in a central section of the second housing and a first arc structure being located on an inner surface around the air inlet of the second housing, a thickness of the first arc structure decreasing progressively from the air inlet along a radial outward direction, a plurality support brackets respectively extending from an end close to a tongue of the second housing and an end away from the tongue of the second housing for connecting with a support plate, the support brackets being perpendicular to the second housing;

an annular guide ring located in all outer margin of the blades and having a second arc structure located in an inner surface close to an outermost margin of the blades, a thickness of the second arc structure decreasing progressively from the outermost margin of the blades along a radial inward direction, the second arc structure being arranged opposite to the first arc structure and a gap being formed between the second arc structure and the first arc structure; and a driving device located in the support plate and being connected to the hub for rotating the centrifugal impeller.

2. The centrifugal fan of claim 1, wherein an outer surface of the second housing is essentially coplanar with an outer surface of the annular guide ring.

3. The centrifugal fan of claim 1, wherein a perpendicular length from the support plate to the first housing is greater than a perpendicular length from the centrifugal impeller to the first housing.

4. The centrifugal fan of claim 1, wherein the support plate is non-coplanar with the outer surface of the second housing and a gap is formed between the support plate and the blades.

5. The centrifugal fan of claim 1, wherein the gap between the second arc structure and the first arc structure ranges from 0.3 mm to 0.5 mm.

6. The centrifugal fan of claim 1, wherein the annular guide ring further comprises a planar structure, and a thickness of the planar structure ranges from 0.3 mm to 0.5 mm.

7. The centrifugal fan of claim 6, wherein a maximum thickness of the first arc structure is 1.5 times to 2.5 times the thickness of the planar structure.

8. The centrifugal fan of claim 1, wherein the second housing further comprises a planar structure and a thickness of the planar structure is 0.3 to 0.4 times the maximum thickness of the first arc structure.

9. A centrifugal fan, comprising:

a centrifugal impeller having a hub and a plurality of blades, the blades being connected to and disposed around the hub in an angularly spaced-apart manner;

a first housing and a second housing cooperatively defining a hollow chamber and an air outlet, an air inlet being formed in a central section of the first housing and a first arc structure being located in an inner surface around the air inlet of the first housing, a thickness of the first arc structure decreasing progressively from the air inlet along a radial outward direction;

an annular guide ring located in an outer margin of the blades and having a second arc structure close to an outermost margin of an inner surface of the blades, a thickness of the second arc structure decreasing progressively from the outermost margin of the blades along a radial inward direction, the second arc structure being arranged opposite to the first arc structure and a gap being formed between the second arc structure and the first arc structure; and a driving device located in the second housing and being connected to the hub for rotating the centrifugal impeller.

10. The centrifugal fan of claim 9, wherein an outer surface of the first housing is essentially coplanar with an outer surface of the annular guide ring.

11. The centrifugal fan of claim 9, wherein the gap between the second arc structure and the first arc structure ranges from 0.3 mm to 0.5 mm.

12. The centrifugal fan of claim 9, wherein the annular guide ring further comprises a planar structure and a thickness of the planar structure ranges from 0.3 rum to 0.5 mm.

13. The centrifugal fan of claim 12, wherein a maximum thickness of the first arc structure is 1.5 times to 2.5 times the thickness of the planar structure.

14. The centrifugal fan of claim 12, wherein the second housing further comprises a planar structure and a thickness of the planar structure is 0.3 to 0.4 times the maximum thickness of the first arc structure.

* * * * *